US010961724B2

(12) United States Patent
Rouillard

(10) Patent No.: US 10,961,724 B2
(45) Date of Patent: Mar. 30, 2021

(54) POWERED CONCRETE FINISHING APPARATUS HAVING ANNULAR WORKING SURFACE

(71) Applicant: 2544-9455 QUÉBEC INC., Charlesbourg (CA)

(72) Inventor: Benoit Rouillard, Québec (CA)

(73) Assignee: 2544-9455 QUEBEC INC.

( * ) Notice: Subject to any disclaimer, the term of this patent is extended or adjusted under 35 U.S.C. 154(b) by 0 days.

(21) Appl. No.: 16/305,746

(22) PCT Filed: Dec. 20, 2016

(86) PCT No.: PCT/CA2016/051514
§ 371 (c)(1),
(2) Date: Nov. 29, 2018

(87) PCT Pub. No.: WO2018/112595
PCT Pub. Date: Jun. 28, 2018

(65) Prior Publication Data

US 2020/0318367 A1 Oct. 8, 2020

(51) Int. Cl.
*E04F 21/24* (2006.01)

(52) U.S. Cl.
CPC ..... *E04F 21/248* (2013.01); *E04F 21/247* (2013.01)

(58) Field of Classification Search
CPC ..... E04F 21/248; E04F 21/247
See application file for complete search history.

(56) References Cited

U.S. PATENT DOCUMENTS

| | | | | |
|---|---|---|---|---|
| 1,988,193 A | | 1/1935 | Edstrom | |
| 2,097,806 A | | 11/1937 | Weidrich | |
| 2,109,933 A | * | 3/1938 | Sloan | E04F 21/248 404/112 |
| 2,208,801 A | * | 7/1940 | Mincher | E04F 21/248 404/112 |
| 2,289,247 A | * | 7/1942 | Davis | E04F 21/248 404/112 |
| 2,749,681 A | | 6/1956 | Reidenbach | |
| 2,900,883 A | * | 8/1959 | Dening | E04F 21/248 404/133.1 |

(Continued)

FOREIGN PATENT DOCUMENTS

JP 3694751 9/2005

OTHER PUBLICATIONS

ETR—PCT—I.S.R. and W.O PCT/CA2016/051514.

*Primary Examiner* — Abigail A Risic
(74) *Attorney, Agent, or Firm* — Lavery, De Billy, LLP; Gonzalo Lavin

(57) ABSTRACT

Powered concrete finishing apparatus including a working head for working the concrete. The working head has a rotatable working surface having a ring shape in contact with the concrete during a finishing operation. The concrete finishing apparatus further includes a motor for driving the working head to perform a rotational working movement on the concrete during the finishing operation. The working surface comprises a clearance for allowing concrete to aggregate within said clearance. The clearance is free of additional working surfaces contacting the concrete during the finishing operation, such as blades, pans, floats or arms, thereby providing an improved finishing of the concrete.

27 Claims, 12 Drawing Sheets

(56) References Cited

U.S. PATENT DOCUMENTS

| | | | | |
|---|---|---|---|---|
| 3,361,044 | A | 1/1968 | Wolf | |
| 4,317,314 | A | 3/1982 | Carlstrom | |
| 5,221,156 | A | 6/1993 | Harlan | |
| 5,449,406 | A * | 9/1995 | Presti, Jr. | E04F 21/248 118/244 |
| 5,882,249 | A * | 3/1999 | Ferland | E04F 21/248 451/359 |
| 5,911,620 | A | 6/1999 | Spangenberg | |
| D472,248 | S | 3/2003 | Riess | |
| 7,018,132 | B2 | 3/2006 | Ewer | |
| 7,104,725 | B1 | 9/2006 | Kipp | |
| 7,144,194 | B2 | 12/2006 | Kipp | |
| 7,775,741 | B2 | 8/2010 | Copoulos | |
| 7,815,393 | B2 | 10/2010 | Snyder | |
| 7,891,906 | B2 | 2/2011 | Quinzi | |
| 8,282,313 | B2 | 10/2012 | Tijerina | |
| 2005/0238429 | A1* | 10/2005 | Kipp, Jr. | E04F 21/248 404/112 |
| 2005/0254897 | A1* | 11/2005 | Ewer | E04F 21/248 404/112 |
| 2009/0190999 | A1* | 7/2009 | Copoulos | B24B 41/047 404/75 |
| 2009/0214294 | A1* | 8/2009 | Quenzi | E04F 21/248 404/75 |
| 2009/0297269 | A1* | 12/2009 | Tijerina, Jr. | A01D 42/00 404/97 |
| 2019/0270176 | A1* | 9/2019 | Wetherell | B24B 7/226 |
| 2020/0198091 | A1* | 6/2020 | Wetherell | B24B 37/044 |

* cited by examiner

POWERED CONCRETE FINISHING APPARATUS HAVING ANNULAR WORKING SURFACE

CROSS-REFERENCE TO RELATED APPLICATION

[0001.1] This application is a National Entry Application of PCT application no CA2016/051514 filed on Dec. 20, 2016 and published in English under PCT Article 21(2) on Jun. 28, 2018 as WO 2018/112595 A1. The above document is incorporated herein in its entirety by reference.

FIELD OF THE INVENTION

The present invention relates to a powered concrete finishing apparatus. More specifically, the present invention is concerned with a working head of the powered concrete finishing apparatus.

BACKGROUND OF THE INVENTION

Powered concrete finishing apparatuses of the prior art often comprise a plurality of generally rectangular trowel blades rotating about a common axis and being in contact with the concrete. Examples of walk-behind finishing apparatuses are shown in U.S. Pat. No. 7,018,132 by Ewer et. al and in U.S. Design Pat. No. 472,248 by Riess et al.

Another powered concrete finishing apparatus is disclosed in U.S. Pat. No. 8,282,313 to Tijerina, Jr. This apparatus comprises a rotary circular disc attached at one end of a counter-balanced extension pole with a motor attached at the other end of the extension pole. The apparatus also includes an angled gear drive for driving the disc at the end of the pole. The extension pole, motor, and angled drive assembly are similar to a weed trimmer, with the weed trimmer attachment replaced by the circular disc. However, no gear box is described in the patent so that the disc would presumably rotate at about between 5,000 to 8,000 RPM, which is far too high for a good finishing work.

Other finishing apparatuses of a sit-on type, which use trowel blades, are typically used for finishing large concrete floor surfaces. Several embodiments of finishing apparatuses and bump cutters for use on very large high-tolerance concrete surfaces are disclosed in U.S. Pat. No. 7,891,906 to Quenzi et al. One such embodiment does not include trowel blades but comprises at least two rotatable rings being arranged concentrically and driven in opposite directions. The apparatus disclosed is not properly adapted for fishing concrete at wall edges because it is far too large, thereby not producing good finishing on the wall edges, which may need to be troweled manually with a manual trowel. Another embodiment disclosed is a large diameter, walk-behind rotary bump cutter with a set of four arms having a diameter of 12.67 feet that work or process the concrete surface. However, such embodiment would be very difficult if not impossible to maneuver by the walk-behind user because of its great size as it would unbalance the walk-behind user during operation because of the torque effect of the motor pushing on the arms and the concrete. In yet another embodiment the rotary bump cutter may include a rotatable ring that floats or may be vertically movable relative to the arms to float at the concrete surface. Again, such embodiment would very difficult if not impossible to maneuver by the walk-behind user because of its great size as it would unbalance the walk-behind user during operation because of the torque effect of the motor pushing on the arms and the concrete.

Producing high-quality concrete floors generally requires a plurality of working steps after fresh concrete has been poured. In particular, it is common to use a motorized power trowel with adaptable pans, floats, plates or combination plates attached thereto. All these attachments are adapted to be used at different times during the working process as well as at different rotational speeds of the power trowel and at different angles of attack with respect to the concrete surface.

For example, underneath a plate of a power trowel floats are attached in a flat position, i.e. the angle of attack is zero. This allows the power trowel to float on an unsettled concrete floor. The operator makes a first pass of the concrete surface with a very low rotational speed and displacement pattern. This first pass cuts, places and evens the surface for the next steps of finishing the floor.

More recently, in particular for large concrete surfaces and with large powerful machines, it has become common to use flat pans attached to a power trowel instead of floats for an initial working step of placing the concrete floor. An example of such a pan is shown in FIG. 8A. One reason for this is that pans better carry the weight of large heavy machines on soft uncured concrete. Also, pans may provide for a more even concrete surface than floats, because with pans the start of the finishing process may be delayed until the concrete is harder. However, pans require large power consumption due a high friction between the pan and the concrete floor.

SUMMARY OF THE INVENTION

It is a preferred object of the invention to provide a concrete finishing apparatus with improved finishing performance, in particular around edges, walls or other obstacles without the need of using blades, pans or floats.

More specifically, in accordance with a first aspect of the present invention, there is provided an apparatus for finishing concrete including a working head for working the concrete. The working head has a working surface shaped as a ring or annulus for contacting with the concrete during a finishing operation. The annulus has an inner radius and an outer radius defining a clearance. A ratio of the inner radius to the outer radius ranges between about 0.5 and 0.9, preferably between 0.65 to 0.85. The apparatus further includes a motor operatively connected to the working head for driving a rotational working movement of the annulus on the concrete during the finishing operation so that a concrete cream aggregates within the clearance. The clearance is free of additional working surfaces contacting the concrete during the finishing operation, such as blades, pans, floats or arms.

The apparatus may include a steering member operatively connected to the working head for allowing a user to walk behind and operate the apparatus. In the case of a walk-behind apparatus that is used as an edge finisher, the outer radius of the annulus may range from about 6 or 7 inches to about 14 or 15 inches so that the corresponding outer diameter of the annulus or ring ranges from about 12 to 30 inches. In a larger version of a walk-behind, the outer radius of the annulus may range up to about 18 inches or 24 inches so that the corresponding outer diameter of the annulus or ring ranges from about 36 to 48 inches. The working head may be angled or beveled at an outer and/or inner edge of the working surface. The motor may be connected to the working head via a clutch and gear-box speed reducer, such as a planetary gear, for providing a rotation speed of the annulus ranging from 100 RPM to 500 RPM, preferably below 300 RPM.

According to another aspect of the present invention, there is provided a method for finishing concrete at an edge of a wall by means of the apparatus defined above, the method including: rotating the annulus or ring-shaped working surface in contact with the concrete during the finishing operation at a rotation speed ranging from about 100 RPM to 500 RPM; and moving the working head near the edge of the wall during the finishing operation as concrete cream aggregates within the clearance.

The concrete finishing apparatus of the invention may be adapted for finishing partially set-up concrete. In particular, the finishing apparatus may be used for a first working step in the process of finishing the concrete floor.

According to another aspect of the present invention, there is provided a working head for an apparatus for finishing concrete. The working head includes a working surface shaped as an annulus or ring for contacting with the concrete during a finishing operation. The annulus has an inner radius and an outer radius defining a clearance. The ratio of the inner radius to the outer radius ranges between about 0.5 and 0.9. This working head may be used to replace a pan or disc of an existing concrete finishing apparatus, which may be either a walk-behind type or a sit-on type. In case of a sit-on type of concrete finisher apparatus, the outer radius of the annulus may range from about 18 to 24 inches which corresponds to an outer diameter of 36 to 48 inches.

In another aspect of the invention there is provided a working surface shaped as a ring or annulus that is mountable to a powered concrete finishing apparatus, for example a concrete finishing apparatus in accordance with any of the embodiments described herein. The working surface is adapted to contact with the concrete during a finishing operation, wherein the working surface comprises a clearance for allowing concrete cream to aggregate within said clearance.

According to another aspect of the present invention, there is provided a method for replacing a set of blades or at least one disc or pan or float from an existing concrete finishing apparatus. The method involves removing the set of blades or the at least one disc or pan or float from the concrete finishing apparatus and then installing a working head as defined above on the existing concrete finishing apparatus. The existing finishing apparatus may be a walk-behind or a sit-on type.

Other objects, advantages and features of the present invention will become more apparent upon reading of the following non-restrictive description of specific embodiments thereof, given by way of example only with reference to the accompanying drawings.

BRIEF DESCRIPTION OF THE DRAWINGS

In the appended drawings:

FIGS. 7A and 7B are side section views illustrating the behavior of a working head on unfinished concrete, wherein FIG. 7A shows a working head of the prior art and FIG. 7B shows a working head in accordance with another embodiment of the invention;

DESCRIPTION OF ILLUSTRATIVE EMBODIMENTS

The present invention is illustrated in further details by the following non-limiting examples.

Concrete Edge Finisher

Figure 1:
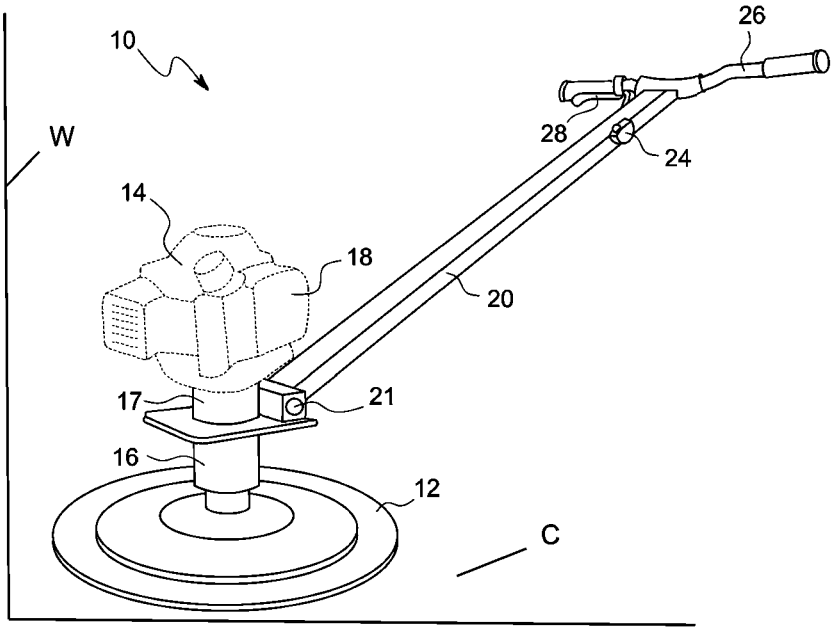
FIG. 1 is a perspective view of a concrete finishing apparatus embodied as an edge finisher, in accordance with an embodiment of the invention.
Figure 3:
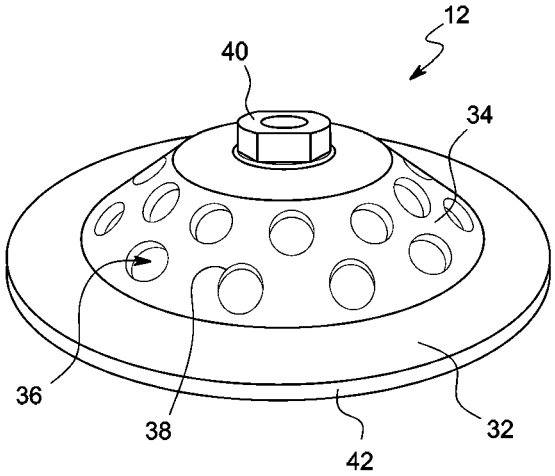
FIG. 3 is a perspective view of a working head, in accordance with an embodiment of the invention.

Referring now to FIG. 1, there is shown a concrete finishing apparatus 10, which is embodied as a concrete edger finisher, having a working head 12. Referring now to FIG. 3 in addition to FIG. 1, the working head 12 supports a working surface shaped as a rotatable ring or annulus A having an inner radius r and an outer radius R defining a clearance 36 for finishing a concrete surface C. The apparatus 10 includes a motor 14 operatively connected to the working head 12 for driving a rotational working movement of the annulus A. The rotation of the annulus A may be driven via a planetary gear box 16 and clutch 17, although it would also be possible to rotate the annulus A through another type of gear box or any suitable system for achieving proper speed control such as a speed reducer system. The motor 14 may be an internal combustion engine, for example a 1.5 horsepower engine of 35 cc, with a fuel reservoir 18, but any other type of motor, such as an electric motor, could be used. In case of an electric motor, the concrete finishing apparatus may comprise a carry on, preferably rechargeable, battery so as to be cordless.

Figure 2:
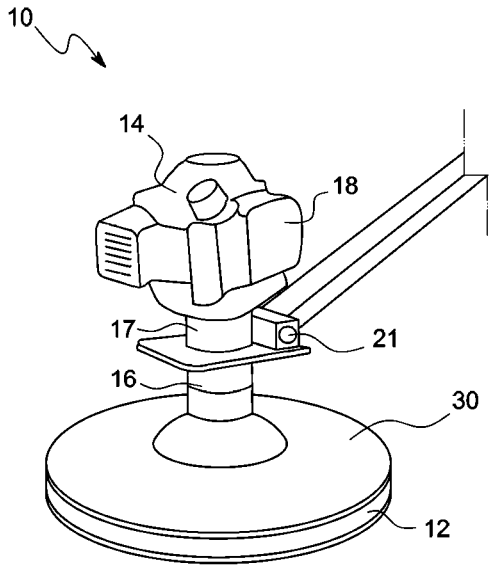
FIG. 2 is a perspective view of a concrete finishing apparatus embodied as an edge finisher, in accordance with another embodiment of the invention.

The concrete edge finishing apparatus 10 shown in FIGS. 1 and 2 are of a walk-behind type and further comprise a steering member 20 for allowing a person (not shown) standing or walking behind the concrete finishing apparatus 10 to operate it. The steering member 20 is adjustable in height by an adjustable pivot 22. The steering member 20 further comprises an ON/OFF-switch 24 near a handle portion 26 and a gravity switch for security. A variable throttle control 28 is disposed at one handle of the handle portion 26.

Referring back to FIG. 1, the outer radius R of the annulus A mounted on the working head 12 is of about 7 inches while the inner radius r of the annulus A is of about 6 inches. In other words, the annulus A has an outer diameter of about 14 inches while the clearance 36 has a diameter of about 12 inches. Of course, other diameters sizes are possible for the working head 12 and annulus A.

The working head 12 may have a flat and generally cylindrical body defining a generally circular working surface (the bottom surface of the working head 12 not visible in FIG. 1) and a circular clearance 36 (shown in FIG. 3 for example) in that working surface which is concentric with the cylindrical body.

Referring back to FIG. 2, the concrete finishing apparatus 10 that is illustrated is similar to the concrete finishing apparatus 10 of FIG. 1 but has a different working head 12 comprising a protective cap 30 made from plastic or any other suitable lightweight material. The protective cap 30 is fixed to power unit including the motor 14 but it does not rotate with the ring or annulus A.

Referring back to FIG. 3, the working head 12 of a further embodiment is shown. The working head 12 has a generally hat-like shape or with a ring-shaped flat body 32 and a hollow conical portion or dome 34 extending across a central clearance 36 of the ring-shaped flat body 32. The conical portion 34 may include a plurality of openings 38 that allow viewing the aggregated concrete cream inside the clearance 36 and reduce the weight of the apparatus 10. The working head 12 further comprises a hub 40 for connecting the working head 12 to a shaft of a motor or gear box.

Preferably, the ring-shaped flat body 32 is made from steel and/or the conical portion 34 is made from cast aluminum. For example, the flat body 32 and the conical portion 34 may be connected to each other by mechanical fasters, welding, brazing or other suitable methods. Alternatively, the flat body 32 and conical portion or dome 34 may be integrally formed, for example from a cast material such as steel or aluminum. However, other materials, such as magnesium or cast iron, or non-metal materials, such as plastic, may also be used. Also, the working head 12 may be cold or hot formed.

A replaceable wear ring 42 facing the concrete surface during operation is disposed at an underside of the ring-shaped flat body 32 or at any other working head 12 as described herein. This may prolong the service life of the working head 12.

Figure 4A:
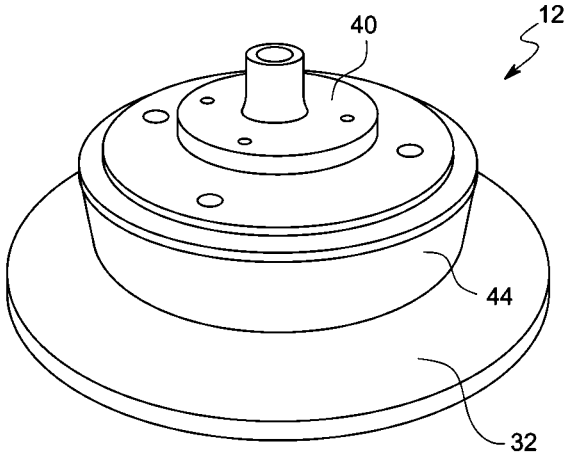
FIGS. 4A to 4C are perspective views of different working head in accordance with other embodiments of the invention.

Another working head 12 of generally hat-like shape or dome shape is shown in FIG. 4A. The working head 12 comprises a ring-shaped flat body 32 and a hollow cylindrical portion 44 extending around a central clearance (not visible in FIG. 4) of the ring-shaped flat body 32. The flat body 32 and the cylindrical portion 44 may be connected to each other in a similar way as described with respect to flat body 32 and conical portion or dome 34 of FIG. 3.

Still with reference to FIG. 4A, the working head 12 further comprises a hub 40 for operative connection to a motor 14 or gear box 16 of the type shown in FIG. 1. The hub 40 covers an upper end of the cylindrical portion 44. In contrast to the working head 12 of FIG. 3 having openings 38, the working head 12 is completely closed in an upward direction, although openings may as well be provided, e.g. to allow viewing the aggregate concrete cream within the clearance and to reduce the weight of the working head.

Figure 4B:
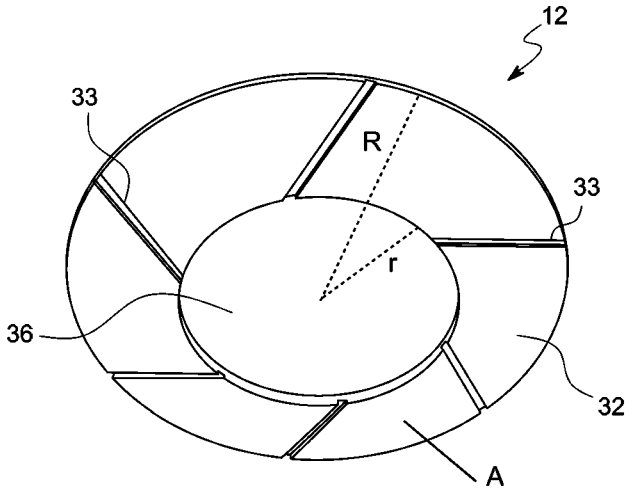

Referring to FIG. 4B, there is shown the underside of a working head 12 having a ring-shaped flat body 32 similar to the ones discussed above. The underside of the ring-shaped flat body 32 may be provided with grooves 33 that extend from the central clearance 36 to the edge of the flat body 32 for improving the cutting efficiency.

Figure 4C:
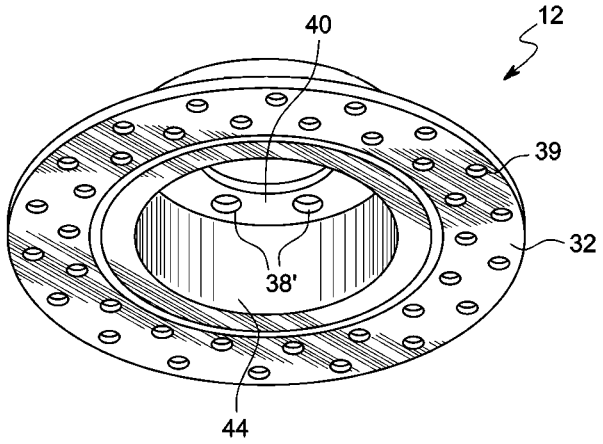

Referring to FIG. 4C, there is shown the underside of a working head 12 similar to the one shown in FIG. 4A with a hub 40 covering an upper end of the cylindrical portion 44. In this embodiment, the hub 40 is provided with openings 38' and the ring-shaped flat body 32 is provided with openings 39. The openings 38' and 39 advantageously reduce the weight of the working head 12.

Figure 5A:
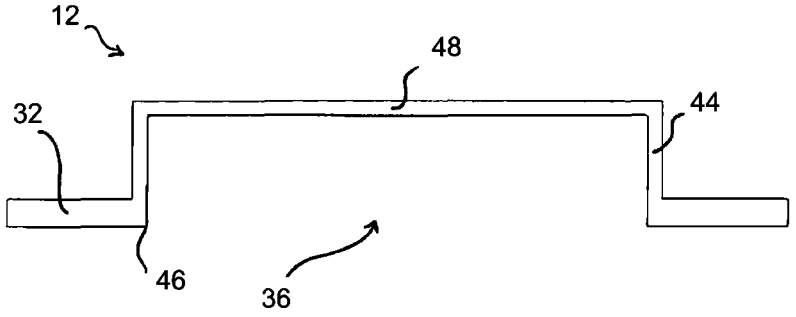
FIGS. 5A to 5C show more embodiments of different working heads in sectional views.
Figure 5B:
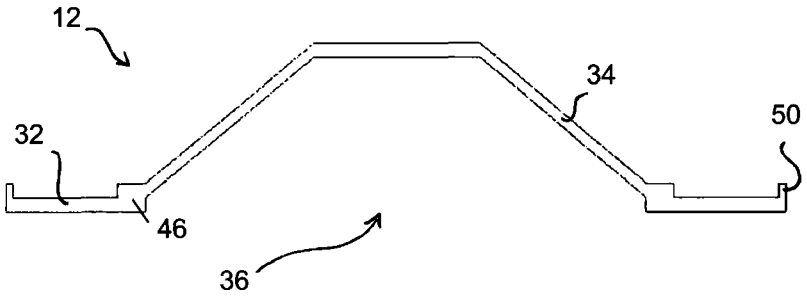
Figure 5C:
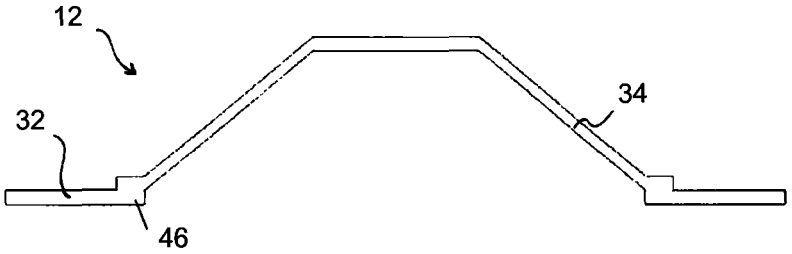

In FIGS. 5A to 5C, other embodiments of working heads are shown. The working head 12 of FIG. 5A comprises a similar shape as the working head 12 of FIG. 4. In particular, the working head 12 of FIG. 5A comprises a ring-shaped flat body 32 and a cylindrical portion 44 extending about an inner edge 46 of the ring-shaped flat body 32, that inner edge 46 defining a central clearance 36 allowing concrete cream to aggregate therein. The cylindrical portion 44 has a closed upper end covered by a horizontal wall 48, which for example may carry a hub for connecting the working head 12 to a motor or gear box.

The working head 12 of FIG. 5B comprises a ring-shaped flat body 32 and a conical portion 34 extending about an inner edge 46 of the flat body 32 and defining a clearance 36. At an outer periphery of the flat body 32, the working head 12 includes a cylindrical wall 50, which may prevent concrete from reaching an upper surface of the flat body 32 and may abut against a wall.

In FIG. 5C a working head 12 is shown having a similar shape as the working head of FIG. 5B but without the cylindrical wall 50. As such, the working head 12 of FIG. 5C comprises an overall shape similar to the working head 12 of FIG. 3. Accordingly, the conical portions 34 of FIGS. 5B and C may be provided with openings, such as for example openings 38 shown in FIG. 3.

In the embodiments described herein, the clearance 36 is free of other working elements, such as trowel blades, and defines an open space allowing concrete cream to aggregate therein. With reference to FIGS. 1 and 2, the working head 12 is the only working surface element of the shown concrete finishing apparatus 10. Hence, the concrete finishing apparatus 10 is of a simple design and easy to use and maintain.

In embodiments, the ratio of the inner radius r to the outer ratio R of the annulus A ranges from 0.5 to 0.9. Therefore, the area of the clearance 36, which corresponds to the area of the inner circle $\pi r^2$ of the annulus A, divided by the area of the outer circle $\pi R^2$ of the annulus A ranges from 0.25 to 0.81. For example, in the case of an edge finisher, an annulus A with an outer radius R of 7 inches (outer diameter of 14 inches) and an inner radius r of 6 inches (inner diameter of 12 inches) has a ratio r/R of 6/7 or 0.857, while it has a ratio $\pi r^2/\pi R^2$ of 36/49 or 0.735.

In known edge finishers, the blades or pan typically defines a circle of 24 inches in outer diameter. As per the present invention, these blades can be replaced by a ring-shaped working surface or annulus A having a corresponding outer diameter of 24 inches or an outer radius R of 12 inches. The inner radius r would then range from about 6 to 10.8 inches corresponding to the ratio r/R that ranges from 0.5 to 0.9.

If the ratio of the inner radius r to the outer ratio R of the annulus A is less than 0.5, the apparatus begins to lose its efficiency as the clearance 36 becomes too small and the apparatus starts to work more as if it has a full disc or solid pan. On the other hand, if ratio of the inner radius r to the outer ratio R of the annulus A is greater than 0.9, then the clearance 36 becomes too large and the apparatus also begins to lose its efficiency as the working surface of the annulus A is too small and the apparatus may start sinking in the concrete.

In other known concrete finishers, the standard sizes of the solid pans or full disks define circles with an outer diameter of 24, 36, 48 or 60 inches. As per the present invention, these pans can be replaced by a ring-shaped working surface or annulus A having a corresponding outer diameter of 24, 36, 48 or 60 inches or an outer radius R of 12, 18, 24 or 30 inches. The inner radius r would then range respectively from about 6 to 10.8 inches, 9 to 16.2 inches, 12 to 21.6 inches, 15 to 27 inches, corresponding to the ratio r/R that ranges from 0.5 to 0.9.

In an example, the annulus may have an outer diameter of 48" (ca. 122 cm) or the outer radius of 24 inches, which corresponds to $\pi R^2$ or 1809 square inches (ca. 11689 $cm^2$) and the clearance may have a diameter of 34" (ca. 86 cm) or inner radius r of 17 inches, which corresponds to 908 square inches (ca. 5,809 $cm^2$). The ratio of the areas is $r^2/R^2$ or $17^2/24^2$ or 0.501, while the ratio of the inner radius to the outer radius is 17/24 or 0.708.

In embodiments, the ratio of the area of the clearance to the area of a ring-shaped working surface may be calculated as follows:

$$\frac{\text{Clearance Area}}{\text{Working Area}} = \frac{\pi r^2}{\pi R^2 - \pi r^2} = \frac{1}{(R/r)^2 - 1}$$

Therefore, for r/R of 0.5 to 0.9, the ratio of the area of the clearance to the ring-shaped working surface ranges from 0.33 to 4.26. These values are derived from the above r/R ranging from 0.5 to 0.9 and can be extrapolated and applied to different shapes of working surfaces that are substantially circular.

In a preferred embodiment, the working head 12 is rotated during a finishing procedure at a speed over 50 RPM, preferably over 200 RPM, and/or under 500 RPM, preferably under 300 RPM, wherein the terms over and under include the given value. Values for speed and clearance as a percentage of the working surface may vary with various parameters, such as the concrete hardness and/or the weight of the concrete finishing apparatus and power of its motor.

Figure 6A:
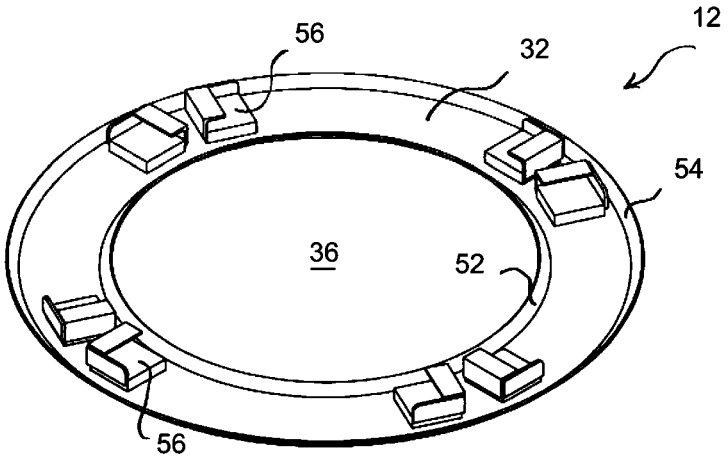
FIGS. 6A and 6B are respectively perspective and top views of a working head for a concrete finishing apparatus in accordance with another embodiment of the invention.
Figure 6B:
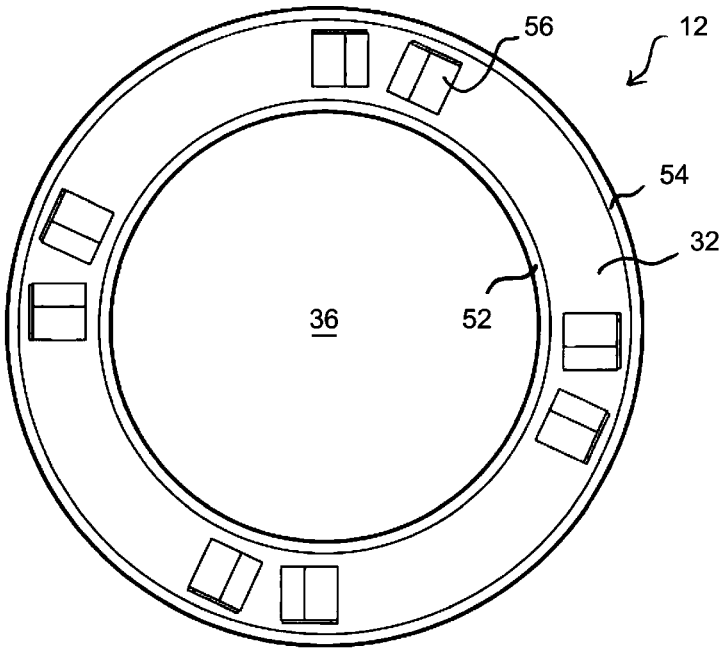

FIGS. 6A and 6B, hereinafter commonly referred to as FIG. 6, depict another working head 12 according to a different embodiment of the invention that is meant to be used to replace a completely solid pan (i.e. without a clearance). The working head 12 includes a ring-pan shape, i.e. it comprises a ring-shaped flat body 32 and annular beveled or angled portions 52, 54 respectively at an inner edge defining a clearance 36 and at an outer edge defining a periphery of the flat body 32. The flat body 32 defines a working surface, which is the bottom surface of the working head 12. In FIG. 6, the working surface is not visible due to the perspective. In general, the working head 12 defines a ring-shaped working surface. In the embodiment of FIG. 6, the clearance amounts to about 68% of the working surface, although other ratios are possible.

The ring-pan shape working head 12 of FIG. 6 can, for example, be manufactured by pressing sheet metal or by welding the annular portions 52, 54 to the flat body 32. Although these methods of manufacture refer to a metal working head, a working head in accordance with the invention may also be made from any other appropriate material, such as, for example, plastic.

The working head 12 of FIG. 6 comprises a plurality of coupling elements 56 that are mounted onto the flat body 32 of the working head 12 opposite a working surface, e.g. by means of welding. Each coupling element 56 comprises a metal sheet flap for engaging with an opposing coupling member (not shown) of a concrete finishing apparatus that normally uses a solid pan to work. In the present embodiment, the coupling elements 56 are organized in pairs on the flat body 32, such that four pairs of coupling elements 56 are evenly distributed over the circular flat body 32.

The connection between the working head and the motor or gear box of the finishing apparatus may be designed in consideration of the apparatus type. For a walk-behind type concrete finishing apparatus, such as an edger, a hub may be directly and/or integrally connected to the working member. In particular, in that scenario, the working head may comprise an outer diameter, in particular of the working surface, of or above 36" (ca. 91 cm) and/or of or below 48" (ca. 122 cm).

For a sit-on type concrete finishing apparatus, one, two or more working heads may be provided and may each be connected to respective shafts of one or more motors or gearboxes by means of a plurality of coupling members, for example engaging with coupling elements of the type described above and referenced as 56. Two or more, in particular five, coupling members may be provided for each working head. The coupling elements may be connecting beams extending from a common hub to the working head. For example, for a sit-on type apparatus, two or more working heads might be employed, wherein each working head may comprise an outer diameter, in particular of the working surface, of or above 24" (ca. 60 cm) and/or of or below 60" (ca. 152 cm), in particular of or above 48" (ca. 122 cm).

Any of the working heads described herein may be used with a walk-behind or with a sit-on concrete finishing apparatus or with any other appropriate concrete finishing apparatus.

Figure 7A:
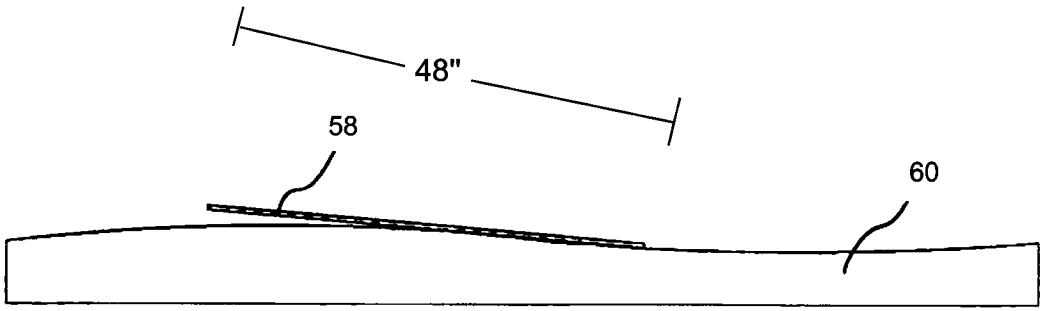
FIG. 7A (Prior Art)
Figure 7B:
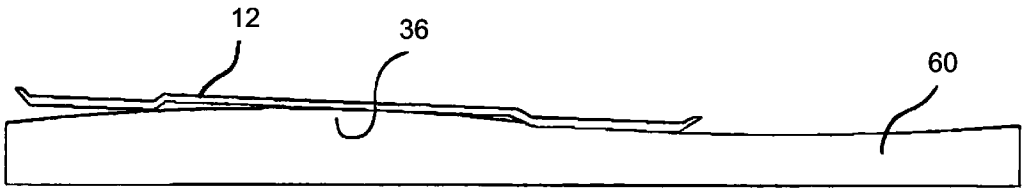

In FIG. 7A, a working head 58 of the prior art is shown together with an unfinished concrete body 60 in a sectional view during a finishing procedure. FIG. 7B, in contrast, shows a working head 12 in accordance with an embodiment of the invention as well as an unfinished concrete body 60 in a sectional view. For the purpose of illustration, FIGS. 7A and B are not to scale but exaggerated, in particular with respect to the shape of the unfinished concrete surface.

The working head 58 comprises a disc-shape, whereas the working head 12 is generally of a ring-pan shape, similar to the one described above with reference to FIG. 6 except that the clearance 36 of the working head 12 of FIG. 7B is not open in an upward direction.

As can be seen in FIG. 7A, during the finishing procedure the disc-shaped working head 58 is in contact with the concrete body 60 mostly with its bottom surface and also with one, in FIG. 7A the right, edge. However, concrete finishing is, for the most part, effectuated by an edge moving over the unfinished concrete surface and not as much by a flat surface moving on the unfinished concrete. Also, due to the linear cross-section of the disc, it is not guaranteed that the right edge or, in fact, any edge is in contact with the uneven concrete surface.

In contrast, the working head 12 of FIG. 7B has two edges in contact with the concrete surface, in particular the interior edges defining the clearance 36. Also, the clearance 36 allows concrete to aggregate therein. In particular, the concrete may form a cream that can aggregate within the clearance 36, wherein the working head 12 facilitates that the concrete cream is brought to the surface of the concrete. Upon further contact with the rotating working head 12, the cream may be evenly distributed over the concrete surface.

Since the working head 12 is born by the two edges, it essentially levels automatically without the need for the operator to steer the orientation of the attached finishing apparatus in detail. Thus, the working head 12 facilitates the production of a particularly even concrete surface and provides for a simple and quick finishing procedure.

Further, the working head 12 requires only a relatively smaller driving power due to the small surface that is in contact with the concrete and, accordingly, due to a small friction. In particular, the surface area of the working head 12 in contact with the concrete is smaller than the surface area of the working head 58 in contact with the concrete. Also, the large and homogenous disk-shape of the working head 58 provokes suction between the working head 58 and the concrete, which further increases friction between the two. The working head 12, in contrast, allows no or only a low degree of suction due to the clearance 36. Thus, the working head 12 has a reduced friction and, therefore, reduced required driving power with respect to the pan-shaped working head 58.

Formation and aggregation of concrete cream within the clearance 36 depends on the condition of the concrete, in particular on the time that has passed after initially pouring the concrete. Other parameters influencing the formation of concrete cream in the clearance 36 may include ambient temperature and humidity, quantity of spread water, previous treatments of the concrete and composition of concrete ingredients.

In particular, the concrete finishing apparatus of the invention should be used, when the concrete is partially set up, for example when the concrete has cured enough to generally carry the weight of the concrete finishing apparatus as well as its operator while the surface of the concrete is still workable.

Replacement of Pans With Ring or Annulus

In FIGS. 8B to G different embodiments of working heads of the invention are depicted in sectional views. The working heads 12 are of a ring-pan shape similar to the ones described with reference to FIG. 6. FIG. 8A shows a pan-type working head 62 of the prior art. For simplicity, reference numerals are only indicated once in FIGS. 8B to G but apply to the other FIGS. 8B to G as appropriate.

As can be seen in FIG. 8B, a working head 12 can include a central clearance 36 that is open in an upward direction. The clearance 36 can also be closed in an upward direction, such as is the case in FIGS. 8C to G, wherein the clearance 36 is formed in a recess of a bottom surface of the working head 12. It is also possible to provide a partially open clearance, such as in FIG. 3.

Figure 8:
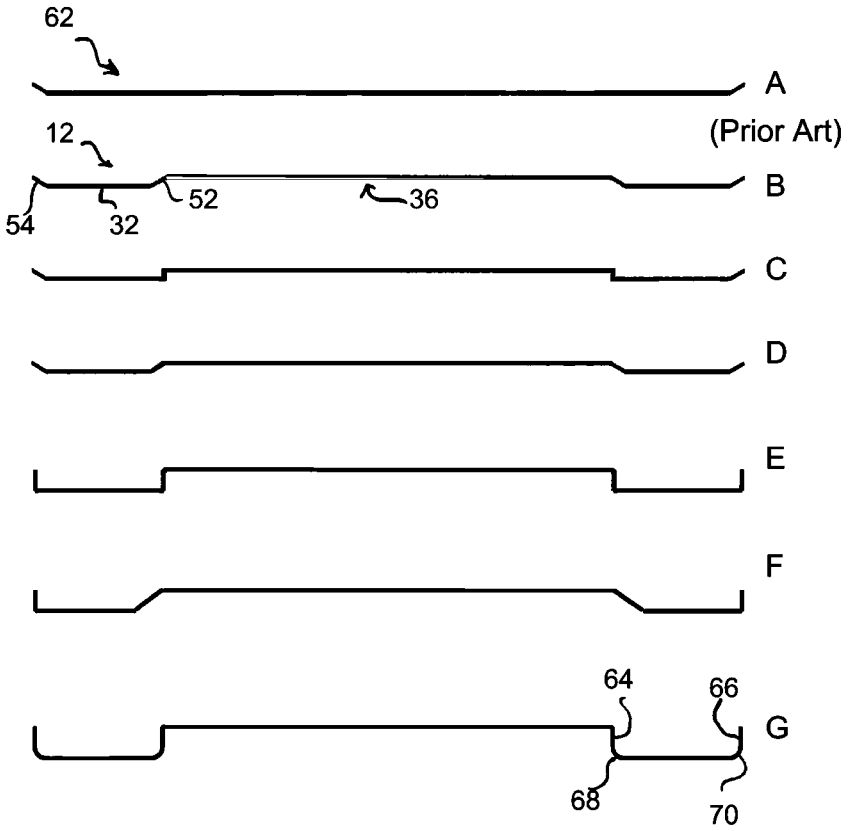
FIG. 8A is a side section view of a working surface or pan for a concrete finishing apparatus known in the prior art.
FIGS. 8B to 8G are side section views showing working surfaces of a working head for a concrete finishing apparatus, in accordance with different embodiments of the invention and illustrate their differences over a pan of the prior art as shown in FIG. 8A.

As can further be seen in FIG. 8, the working head 12 can include angled portions 52, 54 at both the inner and outer circumferential edges, as is the case in FIGS. 8B and D. Alternatively, an angled portion can only be provided at the outer edge, as is the case in FIG. 8C, or at the inner edge, as is the case in FIG. 8F. Also, the working head 12 can include a cylindrical portion or wall at one (FIGS. 8C and F) or both (FIG. 8E) of these edges.

The working head 12 shown in FIG. 8G, for example, comprises two cylindrical portions, in particular an inner cylindrical wall 64 and an outer cylindrical wall 66. Further, but not necessarily linked to any cylindrical portions, the working head 12 of FIG. 8G comprises a radius 68, 70 at both the inner and outer edges of the working surface, although a radius at only one edge may be advantageous as well. As can be appreciated, the cylindrical portion or wall will generally result in a sharper edge with respect to an angled portion if no radius is provided.

The provision of angled or cylindrical portions or walls as well as radii as described above is not necessarily linked to a working head of a ring-pan type but may also form an embodiment of a working head of a generally hat-like shape, such as shown in FIGS. 3 and 4, of a disc-shape or of any other working head of the invention.

Figure 9:
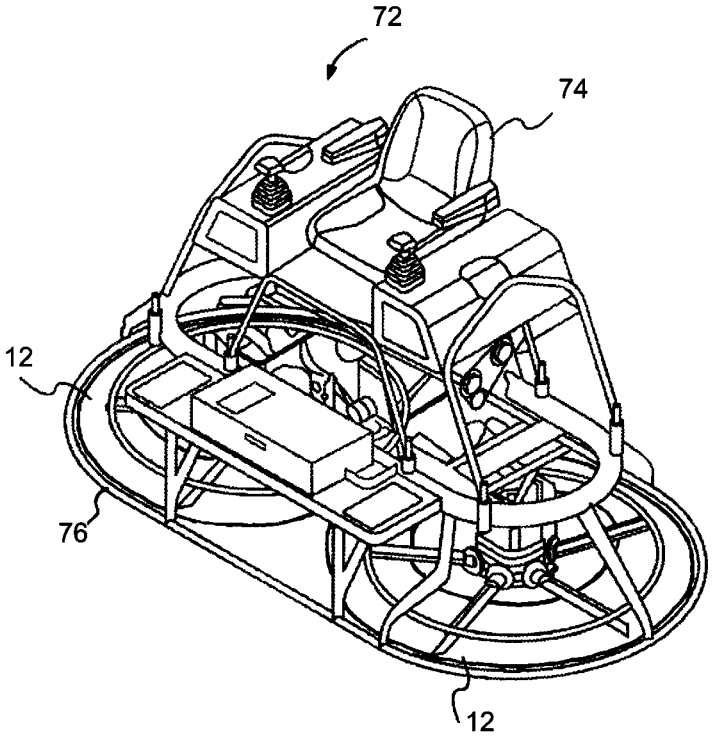
FIG. 9 is a perspective view of a concrete finishing sit-on type apparatus in accordance with another embodiment of the invention.

In FIG. 9, another concrete finishing apparatus 72 in accordance with the invention is shown. The concrete finishing apparatus 72 is of a sit-on type and comprises a seat 74 for an operator to sit on. The type of the concrete finishing apparatus 72 may also be referred to as a rider or ride-on type.

The concrete finishing apparatus 72 further comprises two working heads 12, for example in accordance with one of the embodiments described above. The working heads 12 rotate in opposite directions during a concrete finishing procedure. A guarding member 76 extends around both working heads 12 and comprises a vertical distance with respect to the working surface so as to not get in contact with the concrete surface. The guarding member 76 protects the working heads 12 from obstacles and protects objects, such as persons, from being damaged or injured by the rotating working heads 12. A guarding member may be provided for any type of apparatus and working head described herein.

Although the concrete finishing apparatus 72 can be generally used for larger concrete surfaces than the walk-behind finishing apparatuses of FIGS. 1 and 2, the working heads 12 still provide for a particularly even finished concrete surface due to less suction. In other words, it provides another possibility instead of panning with a walk-behind 48" diameter working surface.

OTHER EMBODIMENTS OF CONCRETE FINISHERS

Figure 10:
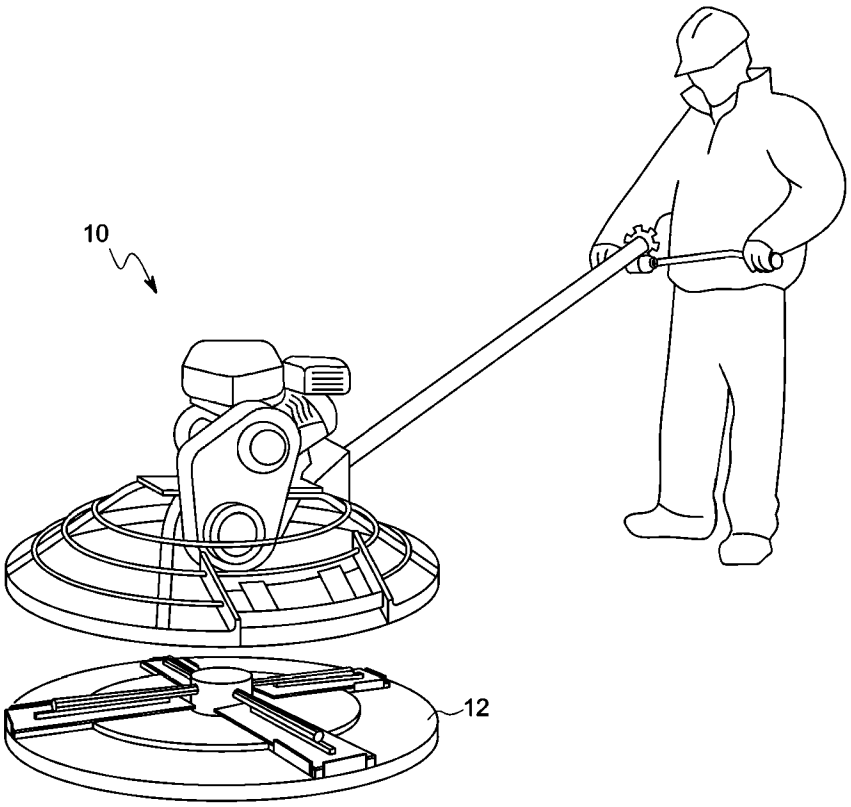
FIG. 10 is a perspective view of another concrete edge finisher, in accordance with another embodiment of the invention.
Figure 11:
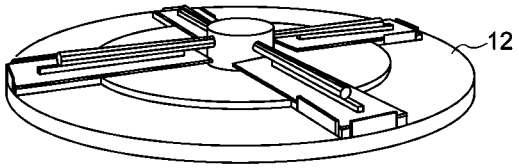
FIG. 11 is a perspective view of a working head of the apparatus shown in FIG. 10.
Figure 12:
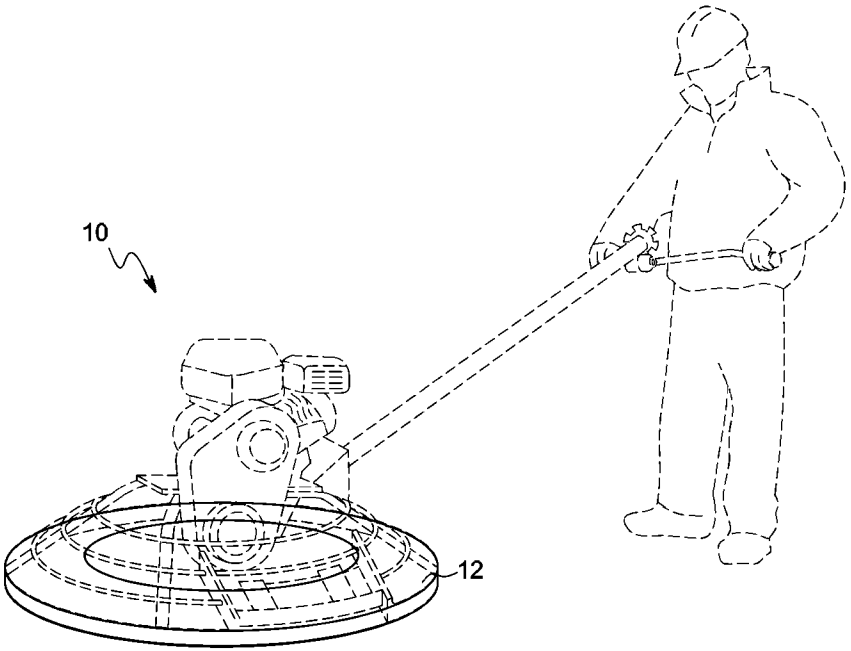
FIG. 12 is a perspective view of the annulus of the working head shown in FIG. 10.

Referring to FIGS. 10 to 12, there is shown another embodiment of concrete finisher 10, according to a preferred embodiment of the present invention. The motor is larger than the one shown in FIG. 1. The working head 12 includes an annulus or ring that may have an outer diameter ranging from about 24 to 48 inches.

The scope of the claims should not be limited by the preferred embodiments set forth in the examples, but should be given the broadest interpretation consistent with the description as a whole.

The invention claimed is:

1. An apparatus (10) for finishing concrete, comprising:

a working head (12) for working the concrete, the working head (12) having a working surface shaped as a single annulus (A) for contacting with the concrete during a finishing operation, the annulus (A) having an inner radius (r) and an outer radius (R) defining a clearance (36), a ratio of the inner radius (r) to the outer radius (R) ranging between about 0.5 and 0.9; and a motor (14) operatively connected to said working head (12) for driving a rotational working movement of the annulus (A) on the concrete during the finishing operation;

wherein the clearance is free of additional working surfaces contacting the concrete during the finishing operation; and wherein during the finishing operation, a concrete cream aggregates within said clearance (36).

2. The apparatus of claim 1, wherein the outer radius (R) of the annulus (A) ranges from about 6 to 18 inches.

3. The apparatus of claim 1, wherein the outer radius (R) of the annulus (A) ranges from about 18 to 24 inches.

4. The apparatus of claim 1, wherein the ratio of the inner radius (r) to the outer radius (R) is between 0.65 to 0.85.

5. The apparatus of claim 1, comprising a steering member (20) operatively connected to the working head (12) for allowing a user to walk behind and operate the apparatus.

6. The apparatus of claim 1, wherein the motor (14) is connected to the working head (12) via a gear-box (16) and clutch (17) and for providing a rotation speed of the annulus ranging from 100 RPM to 500 RPM.

7. The apparatus of claim 6, wherein the gear-box (16) is a planetary gear-box.

8. The apparatus of claim 6, wherein the rotation speed of the working surface is less than 300 RPM.

9. The apparatus of claim 1, wherein said working head (12) comprises an inner edge defining said clearance (36) and an outer edge defining a periphery of said working surface, wherein at the inner edge and/or at the outer edge the working head (12) comprises an angled surface angled away from the concrete.

10. The apparatus of claim 1, wherein said working head (12) comprises an inner edge defining said clearance (36) and an outer edge defining a periphery of said working surface, wherein the inner edge and/or the outer edge are substantially rectangular edges.

11. The apparatus of claim 1, comprising a seat for allowing a user to sit while operating the apparatus.

12. A method for finishing concrete (C) at an edge of a wall (VV) by means of the apparatus of claim 1, the method comprising:

rotating the annulus (A) in contact with the concrete (C) during the finishing operation at a rotation speed ranging from about 100 RPM to 500 RPM; and moving the working head (12) near the edge of the wall (VV) during the finishing operation as concrete cream aggregates within said clearance (36).

13. The method of claim 12, wherein the apparatus comprises a steering member (20) operatively connected to the working head (12) for allowing a user to walk behind and operate the apparatus, the method further comprising: operating the apparatus by means of the steering member (20).

14. The method of claim 12, further providing that the outer radius (R) of the annulus (A) ranges from about 6 to 18 inches.

15. The method of claim 12, further providing that the outer radius (R) of the annulus (A) ranges from about 18 to 24 inches.

16. The method of claim 12, further providing that the ratio of the inner radius (r) to the outer radius (R) is between 0.65 to 0.85.

17. A working head (12) for an apparatus for finishing concrete, the working head (12) comprising a working surface shaped as a single annulus (A) for contacting with the concrete during a finishing operation, the annulus (A) having an inner radius (r) and an outer radius (R) defining a clearance (36), a ratio of the inner radius (r) to the outer radius (R) ranging between about 0.5 and 0.9, the clearance being free of additional working surfaces contacting the concrete during the finishing operation.

18. The working head (12) of claim 17, comprising at least one coupling element (56) for removably coupling the working head (12) to the apparatus.

19. The working head (12) of claim 17, wherein the working surface is connected to a dome (34) above the clearance (36) defining a generally hat-like shape.

20. The working head (12) of claim 17, wherein an underside of the annulus (A) for contacting the concrete defines a flat body (32) provided with grooves (33) that extend from the clearance (36) to an edge of the flat body (32).

21. The working head of claim 17, wherein the outer radius (R) of the annulus (A) ranges from about 6 to 18 inches.

22. The working head of claim 17, wherein the outer radius (R) of the annulus (A) ranges from about 18 to 24 inches.

23. The working head of claim 17 wherein the ratio of the inner radius (r) to the outer radius (R) is between 0.65 to 0.85.

24. A method for replacing a set of blades or at least one disc or pan or float from a concrete finishing apparatus, the method comprising:

removing the set of blades or the at least one disc or pan or float from the concrete finishing apparatus;

installing a working head (12) as defined in claim 17 on the concrete finishing apparatus.

25. The method of claim 24, wherein the apparatus comprises a steering member (20) operatively connected to the working head (12) for allowing a user to walk behind and operate the apparatus, the method further comprising: operating the apparatus by means of the steering member (20).

26. The method of claim 24, further providing that the apparatus comprises a seat for allowing a user to sit while operating the apparatus.

27. An apparatus (10) for finishing concrete, comprising:

a working head (12) for working the concrete, the working head (12) having a working surface for contacting with the concrete during a finishing operation, the working surface defining a single ring having central clearance (36), a ratio of the area of the clearance to the area of the working surface ranging between about 0.33 and 4.26; and a motor (14) operatively connected to said working head (12) for driving a rotational working movement of the working surface on the concrete during the finishing operation;

wherein the clearance is free of additional working surfaces contacting the concrete during the finishing operation; and wherein during the finishing operation, a concrete cream aggregates within said clearance (36).

* * * * *